US009512650B2

(12) United States Patent
Faruque et al.

(10) Patent No.: US 9,512,650 B2
(45) Date of Patent: Dec. 6, 2016

(54) HOOD LATCH RELEASE SYSTEM

(71) Applicant: Ford Global Technologies, LLC, Dearborn, MI (US)

(72) Inventors: Mohammed Omar Faruque, Ann Arbor, MI (US); Iskander Farooq, Novi, MI (US); Srinivasan Sundararajan, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 485 days.

(21) Appl. No.: 13/709,682

(22) Filed: Dec. 10, 2012

(65) Prior Publication Data

US 2014/0159386 A1 Jun. 12, 2014

(51) Int. Cl.

| | |
|---|---|
| ***E05C 3/06*** | (2006.01) |
| ***E05B 77/08*** | (2014.01) |
| ***E05B 79/20*** | (2014.01) |
| ***E05B 83/24*** | (2014.01) |

(52) U.S. Cl.

CPC ..... *E05B 77/08* (2013.01); *E05B 79/20* (2013.01); *E05B 83/24* (2013.01); *Y10T 292/1076* (2015.04)

(58) Field of Classification Search

CPC ..... B60R 21/38; B60R 21/34; B60R 21/136; E05B 77/08; E05B 79/20; E05B 77/12; Y10S 292/22; Y10S 292/65

USPC ..... 292/196, DIG. 14, DIG. 42, DIG. 43,292/DIG. 65

See application file for complete search history.

(56) References Cited

U.S. PATENT DOCUMENTS

| | | | | |
|---|---|---|---|---|
| 3,893,207 | A * | 7/1975 | Rudaitis et al. | 180/69.21 |
| 3,972,549 | A * | 8/1976 | Valade | E05B 77/12 180/274 |
| 5,853,060 | A * | 12/1998 | Chao et al. | 180/69.2 |
| 6,802,556 | B2 * | 10/2004 | Mattsson et al. | 296/187.09 |
| 7,431,359 | B2 * | 10/2008 | Shoji | 293/3 |
| 7,845,691 | B2 * | 12/2010 | Sundararajan et al. | 292/216 |

FOREIGN PATENT DOCUMENTS

| | | |
|---|---|---|
| EP | 1400416 A1 | 3/2004 |
| EP | 1671851 A1 | 6/2006 |

OTHER PUBLICATIONS

European New Car Assessment Programme, Pedestrian Testing Protocol, report, Jan. 2011, 60 pages, Version 5.2.1, European New Car Assessment Programme, Europe.

Proposal for a Regulation on Pedestrian Safety, Working Party on Passive Safety, proposal, Jul. 30, 2010, 42 pages, United Nations Economic and Social Council, Geneva, Switzerland.

* cited by examiner

*Primary Examiner* — Mark Williams

(74) *Attorney, Agent, or Firm* — Raymond Coppiellie; Brooks Kushman P.C.

(57) ABSTRACT

A hood latch release system for a vehicle. The hood latch release system may have a cable and a linkage. Deflection of the cable may actuate the linkage to unlatch the hood latch.

17 Claims, 4 Drawing Sheets

HOOD LATCH RELEASE SYSTEM

TECHNICAL FIELD

The present application relates to a latch release system for a vehicle.

BACKGROUND

A safety device having an actuator member for uplifting a hood is disclosed in EP 1 400 416 A.

SUMMARY

In at least one embodiment, a hood latch release system for a vehicle is provided. The hood latch release system may include a cable and a linkage. The cable may have a first end and a second end. The first end may be fixedly disposed on the vehicle. The second end may be disposed opposite the first end. The linkage may be pivotally disposed on the vehicle and may couple the second end to the hood latch. Deflection of the cable between the first and second ends may actuate the linkage to unlatch the hood latch.

In at least one embodiment, a system for unlatching a hood latch of a vehicle is provided. The system may include a bumper beam, a cable pusher, a linkage, and a cable. The bumper beam may have an opening. The cable pusher may be moveably disposed in the opening. The linkage may be pivotally disposed on the vehicle and may be connected to the hood latch. The cable may have a first end fixedly disposed on the bumper beam and a second end connected to the linkage. The cable pusher may deflect the cable to actuate the linkage and unlatch the hood latch.

In at least one embodiment, a system for unlatching a latch of a vehicle is provided. The system may include a bumper beam, a set of cable pushers, and a cable. The bumper beam may have a set of openings. Each member of the set of cable pushers may be received in a member of the set of openings. The cable may be disposed proximate the bumper beam and may be connected to the latch. At least one member of the set of cable pushers may actuate the cable to unlatch the latch.

DETAILED DESCRIPTION

The illustrated embodiments are disclosed with reference to the drawings. It should be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but merely as a representative basis for teaching one skilled in the art how to practice the disclosed concepts.

Figure 1:
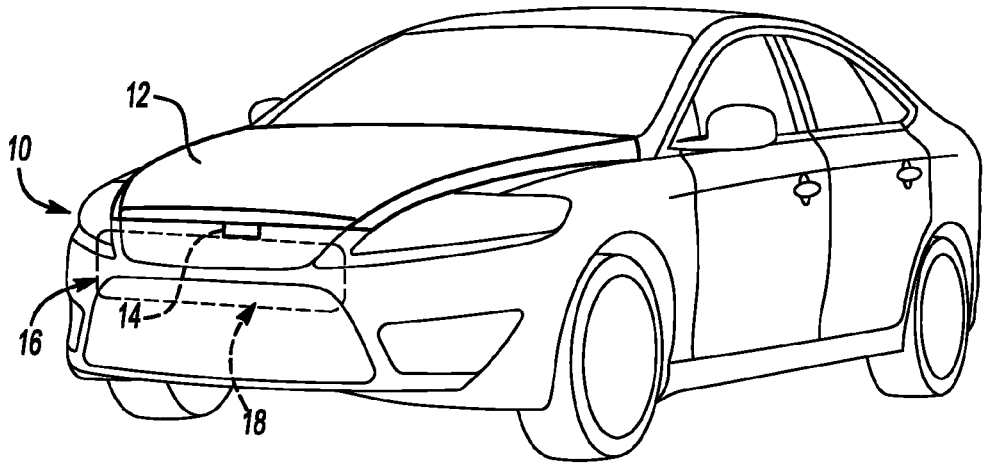
FIG. 1 is a perspective view of a vehicle showing the hood in a latched position.
Figure 2:
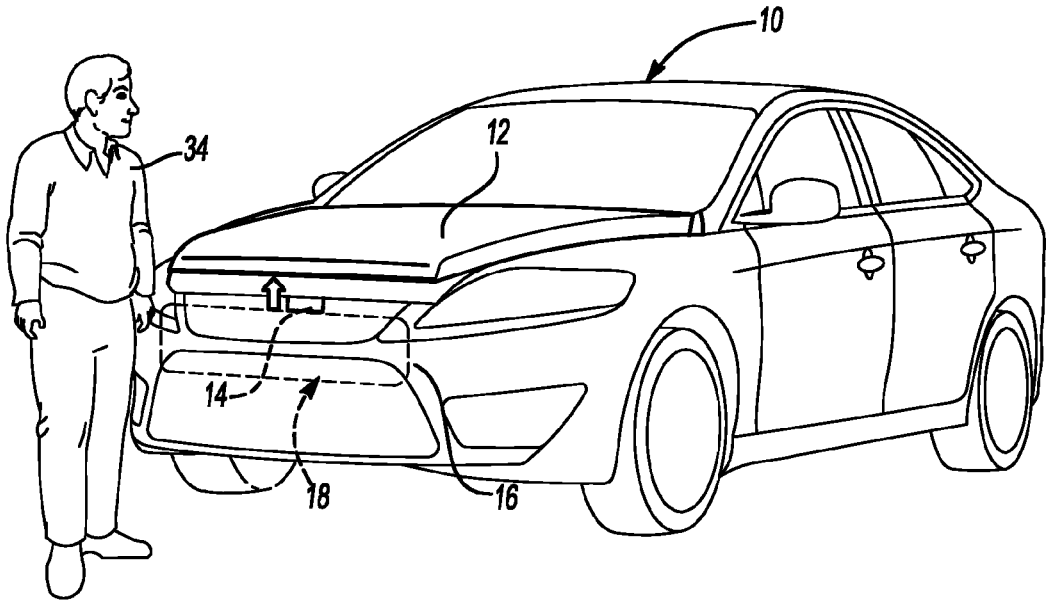
FIG. 2 is a perspective view of the vehicle showing a hood in an unlatched position.

Referring to FIGS. 1 and 2, an exemplary vehicle 10 is shown. The vehicle 10 may be a motor vehicle, such as a car or truck. The vehicle 10 may include one or more closures 12, a latch 14, a bumper 16, and a latch release system 18.

The closure 12 may be a body panel or body panel assembly that is moveably disposed on the vehicle 10. In FIGS. 1 and 2, the closure 12 is configured as a hood that may be pivotally attached to a vehicle body structure and may cover or provide access to an engine compartment. The closure 12 may also be configured as a trunk lid, hatchback, or the like in various embodiments. The closure 12 may move between a closed position and an open position. In the closed position, the closure 12 may cover an opening in the vehicle body structure. In the open position, the closure 12 may be moved or pivot with respect to the vehicle body structure to provide access to an opening. As is best shown in FIG. 3, the closure 12 may have a striker 20 that may extend from the closure 12 to engage the latch 14.

Figure 3:
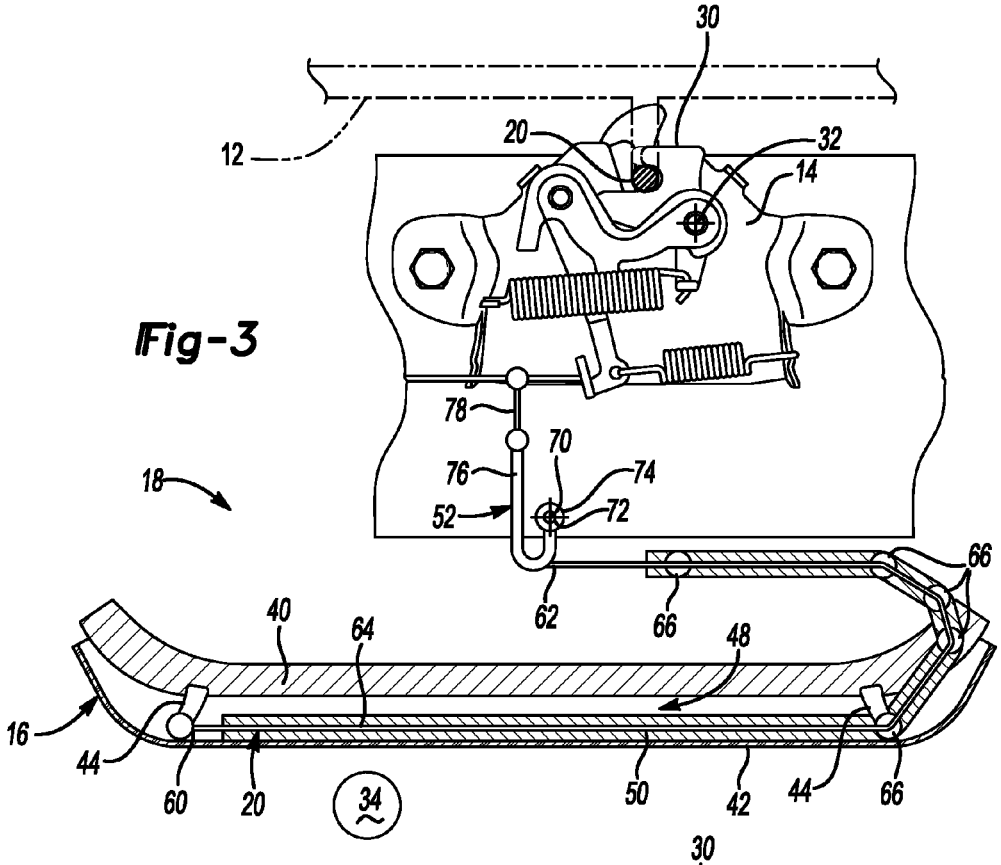
FIG. 3 illustrates a portion of the vehicle and an embodiment of a latch release system in the latched position.

Referring to FIGS. 1-3, the latch 14 may be configured to selectively permit and inhibit movement of the closure 12. In FIG. 1, the latch 14 is configured as a hood latch that may be disposed above the bumper 16. The latch 14 may be fixedly disposed on the vehicle 10 and may be configured to move between a latched position and an unlatched position. In the latched position, a latch arm 30 of the latch 14 may engage the striker 20 and inhibit pivotal movement of the closure 12 away from a closed position. In the unlatched position, the latch arm 30 may rotate about an axis of rotation 32 to disengage the striker 20 and permit movement of the closure 12 from the closed position toward the open position.

Figure 4:
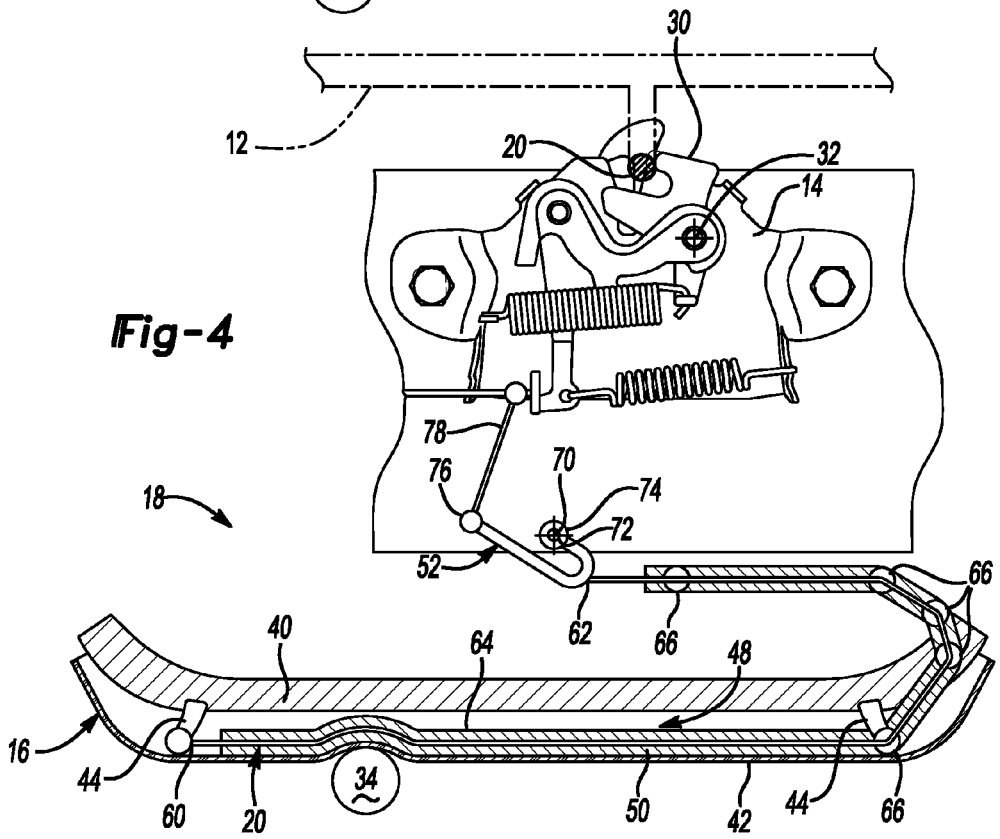
FIG. 4 illustrates a portion of the vehicle and the latch release system in the unlatched position.
Figure 5:
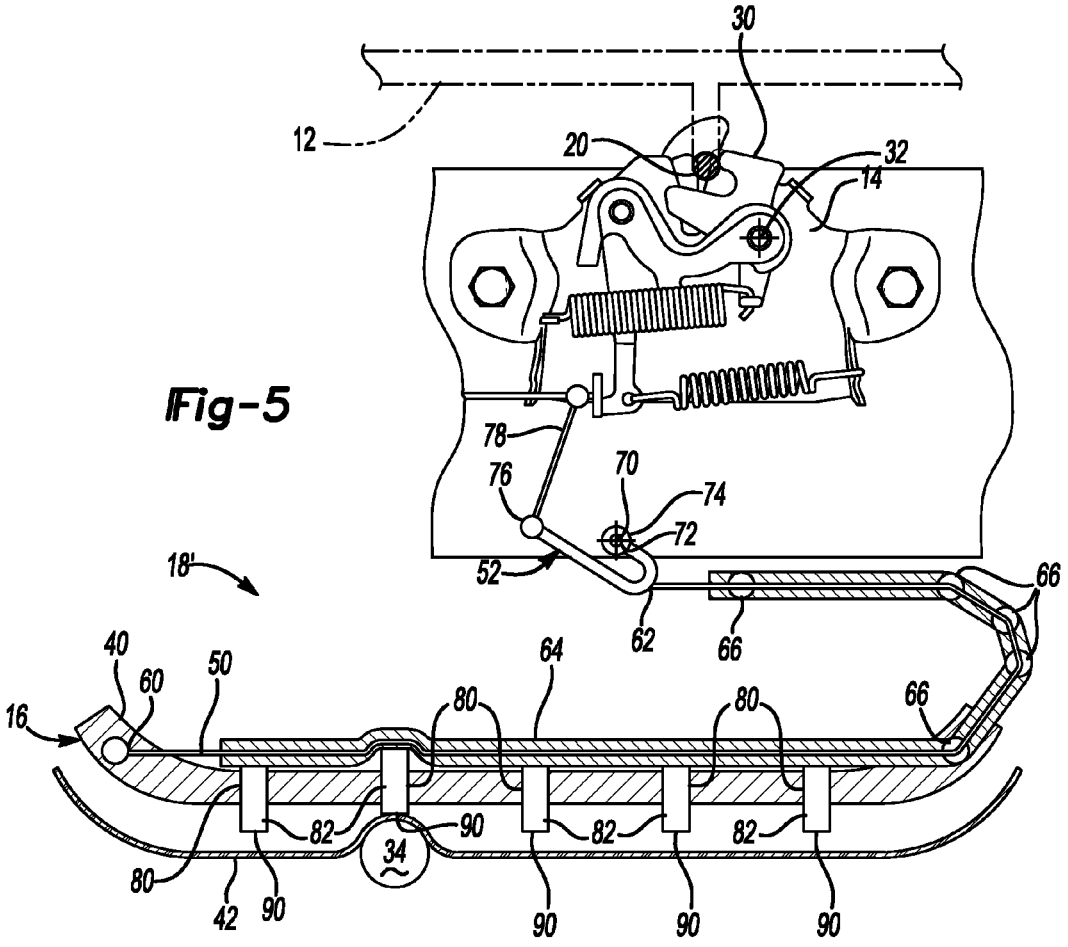
FIG. 5 illustrates a portion of the vehicle and another embodiment of a latch release system in an unlatched position.

The bumper 16 may be disposed at an end of the vehicle 10. In FIGS. 3-5, a top view of the bumper 16 is shown along with a side view of the latch 14 for clarity. The bumper 16 may be configured to absorb energy in response to a vehicle impact event. For example, the bumper 16 may absorb energy during a low speed impact event with an object, such as a pedestrian 34. In at least one embodiment, the bumper 16 may include a bumper beam 40 and a fascia 42.

The bumper beam 40 may be mounted on the vehicle 10 and may be configured as a structural member that may absorb impact load forces. In at least one embodiment, the bumper beam 40 may include one or more cable mounting features 44. A cable mounting feature 44 may extend from the bumper beam 40 toward the fascia 42. In FIG. 3, two cable mounting features 44 are shown that are spaced apart from each other and are disposed near opposite ends of the bumper beam 40.

The fascia 42 may extend at least partially around the bumper beam 40 and may at least partially define an exterior surface of the vehicle 10. At least a portion of the fascia 42 may be spaced apart from the bumper beam 40 such that a gap 48 is formed between the bumper beam 40 and a surface of the fascia 42 that faces toward the bumper beam 40 and/or foam that may be provided between the bumper beam 40 and fascia 42.

The latch release system 18 may include a cable 50 and a linkage 52.

The cable 50 may be configured to actuate the linkage 52. In FIG. 3, the cable 50 is disposed between the bumper beam 40 and the fascia 42. In other embodiments, the cable 50 may be disposed in a different location as will be discussed in more detail below. The cable 50 may have a first end 60 and a second end 62. The first end 60 may be fixedly disposed on the vehicle 10. For example, the first end 60 may be fixedly mounted to the bumper beam 40 or a cable mounting feature 44. In addition, the cable 50 may be spaced apart from the bumper beam 40 between the cable mounting features 44. The second end 62 may be disposed opposite the first end 60. The second end 62 may be coupled to the linkage 52. The cable 50 may extend through and move with respect to a sheath 64 that may extend substantially the length of the cable 50. The cable 50 and/or sheath 64 may extend through one or more cable mounting rings 66. The cable mounting rings 66 may be mounted to or provided on the bumper beam 40 and or fascia 42. The cable mounting rings 66 may support and position the cable 50 while permitting the cable 50 to move through a hole in a cable mounting ring 66.

The linkage 52 may be pivotally disposed on the vehicle 10. For instance, the linkage 52 may be mounted below the latch 14. The linkage 52 may connect the latch 14 to the cable 50 and may be configured to rotate about a linkage axis of rotation 70. For example, the linkage 52 may be pivotally disposed on a pivot pin 72 that may be fixedly disposed on the vehicle 10 and may extend along the linkage axis of rotation 70. The linkage 52 may include a first linkage end 74 and a second linkage end 76. The first linkage end 74 may be disposed proximate the pivot pin 72. The second linkage end 76 may be disposed opposite the first linkage end 74. The second linkage end 76 may be coupled to the latch 14. For instance, the second linkage end 76 may be coupled to the latch 14 via a connecting member 78 of the latch 14. The cable 50 may be coupled to the linkage 52 between the first and second linkage ends 74, 76. In at least one embodiment, the linkage 52 may have a generally J-shaped configuration. The J-shaped configuration may magnify or increase the displacement or distance of movement of the second linkage end 76 with respect to the first linkage end 74 to provide a sufficient length of travel or actuation distance to unlatch the latch 14.

Operation of the latch release system 18 may be best understood with reference to FIGS. 3 and 4.

In FIG. 3, the bumper 16 and the latch release system 18 are shown prior to an impact event. The latch 14 is in the latched position. The fascia 42 is in an initial position. The cable 50 may be in tension, but may not actuate the linkage 52 about the linkage axis of rotation 70.

In FIG. 4, the bumper 16 and the latch release system 18 are shown after an impact event. The fascia 42 may be deformed or deflected in a localized area where the fascia 42 engages the pedestrian 34. Deflection of the fascia 42 may exert force on the cable 50 between the first and second ends 60, 62. The force exerted on the cable 50 may cause the second end 62 of the cable 50 to be pulled toward the first end 60 since the first end 60 is fixedly positioned. Movement of the second end 62 of the cable 50 may rotate the linkage 52 about the linkage axis of rotation 70 in a counterclockwise direction from the perspective shown. Rotation of the linkage 52 exerts force on the latch 14 and causes the latch arm 30 to rotate about the axis of rotation 32 to release the striker 20. As such, the closure 12 may move from the latched position toward the unlatched position. Such movement may increase the distance or clearance between the pedestrian 34 and the underlying hard points of the vehicle body structure, thereby helping to absorb and/or dissipate impact energy and help protect a pedestrian during a low-speed impact event.

Referring to FIG. 5, another embodiment of a latch release system 18' is shown. In this embodiment, the bumper beam 40 may include a set of openings 80 and a set of cable pushers 82. Each opening 80 may receive a cable pusher 82. In addition, the cable 50 may be disposed on a side of the bumper beam 40 that is disposed opposite the fascia 42 or may extend through the bumper beam 40 and/or filler material, such as foam, that may be provided in the bumper beam 40.

The openings 80 may be spaced apart from each other and may extend longitudinally through the bumper beam 40, or in a direction that generally extends away from the fascia 42.

Figure 6:
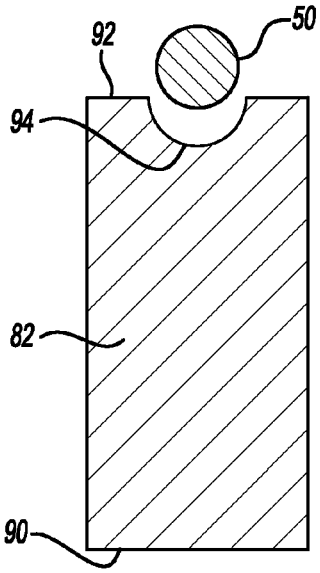
FIG. 6 is a section view of a cable pusher disengaged from a cable of the latch release system of FIG. 5.
Figure 7:
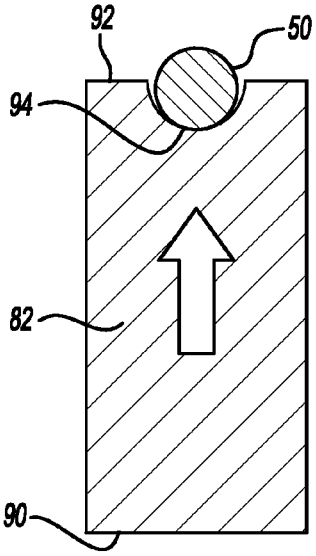
FIG. 7 is a section view of a cable pusher in engagement with a cable of the latch release system of FIG. 5.

A cable pusher 82 may extend through a corresponding opening 80. Moreover, the cable pusher 82 may engage or be assembled to foam that may be provided in the bumper beam 40. Optionally, one or more cable pushers 82 may be mounted to or extend from the fascia 42. The cable pusher 82 may have a first end 90 and a second end 92. The first end 90 may face toward the fascia 42. The second end 92 may be disposed opposite the first end 90 and may face toward the cable 50. As is best shown in FIGS. 6 and 7, the second end 92 may include an indentation 94. The indentation 94 may extend from the second end 92 toward the first end 90 and may be configured to receive and capture the cable 50. In at least one embodiment, the indentation 94 may have a curved surface that may be concave and may be slightly larger than the cable 50 to permit the cable 50 to freely disengage from the cable pusher 82.

The cable pusher 82 may be configured to slide or move through a corresponding opening 80 between a first position and a second position. In the first position, a first end 90 of the cable pusher 82 may be disposed between the bumper beam 40 and the fascia 42. In addition, the first end 90 may be spaced apart from the fascia 42 prior to an impact event. The cable pusher 82 may be configured to remain stationary unless a threshold force level is exceeded to prevent the latch 14 from unlatching during various low speed impact events. The cable pusher 82 may move from the first position to the second position in response to an impact event or sufficient load force. For instance, deformation or deflection of the fascia 42 may cause the fascia 42 to engage one or more cable pushers 82. Such engagement may actuate the cable pusher 82 through the opening 80 such that the cable pusher 82 extends further from a surface of the bumper beam 40 that is disposed opposite the fascia 42. Actuation of the cable pusher 82 through the opening 80 may cause the second end 92 of the cable pusher 82 to engage or actuate the cable 50. Force exerted by the cable pusher 82 on the cable 50 may deflect the cable 50, thereby rotating the linkage 52 and releasing the striker 20 to permit the closure 12 to move from the latched position toward the unlatched position as previously discussed.

Figure 8:
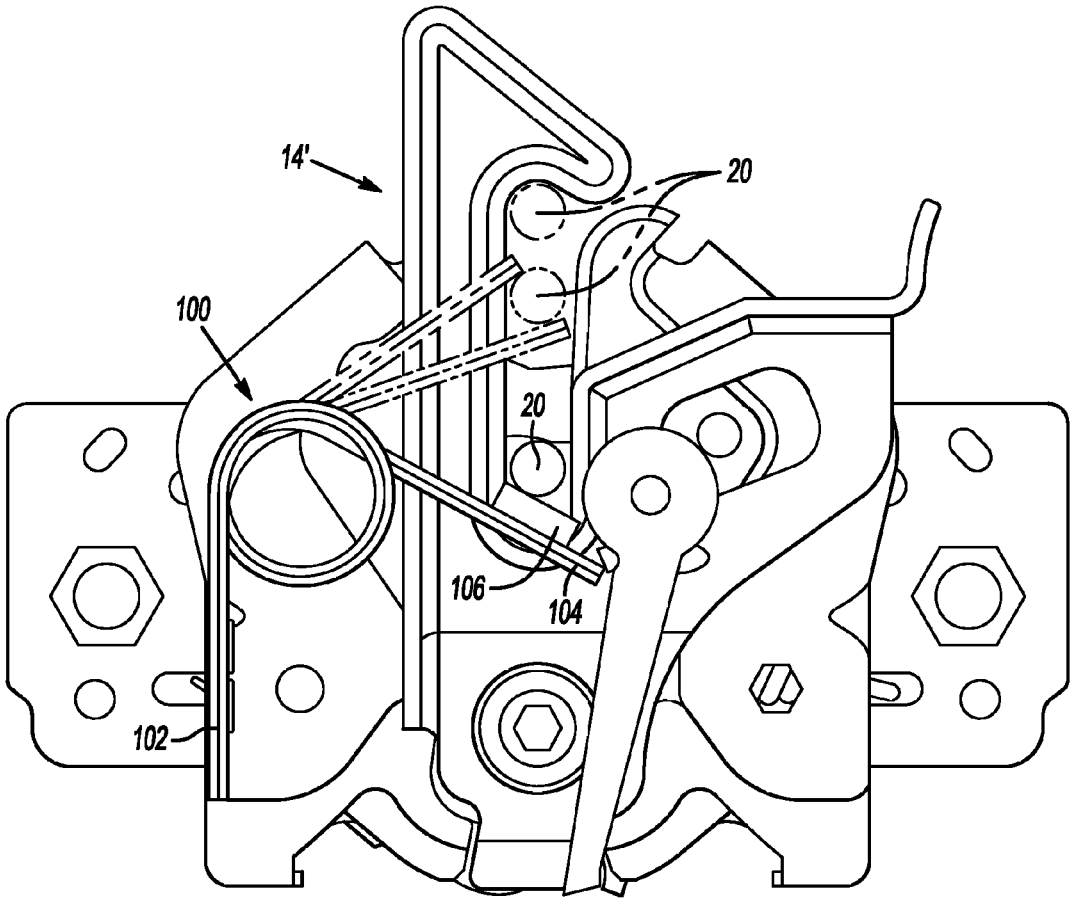
FIG. 8 illustrates another embodiment of a latch that may be used with the latch release system.

Referring to FIG. 8, another embodiment of a latch 14' that may be used with the latch release system 18 is shown. In this embodiment, a biasing member 100, such as a torsion spring, may be provided to accelerate movement of the closure 12 from the closed position to the open position. By accelerating movement of the closure 12 a gap may be provided between the closure 12 and the underlying hard points of the vehicle body structure prior to impact between the closure 12 and a portion of the pedestrian 34, such as the head or upper body. The biasing member 100 may have a first arm 102 that may be held in a fixed position and a second arm 104 that may engage and exert a biasing force on the striker 20. The striker 20 and second arm 104 are shown in three positions. The striker 20 and second arm 104 are shown in solid lines when the closure 12 is in the closed position. A spacer 106, such as a rubber or plastic spacer, may be positioned between the second arm 104 and the striker 20 to inhibit noise due to friction arising from vehicle motion. The striker 20 and second arm 104 may rapidly move to an intermediate position (shown in dashed lines) when the latch 14' is moved to the unlatched position due to operation of the latch release system 18. Subsequently, the striker 20 and second arm 104 may move to or toward the open position (shown in phantom) under the biasing force of the biasing member 100. The stiffness of the biasing member 100 may be adjusted to provide the desired actuation distance and actuation speed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hood latch release system comprising:

a cable having a first end fixedly disposed on a bumper beam and a second end;

a cable pusher that extends through an opening in the bumper beam; and a linkage that couples the second end to a hood latch;

wherein the cable pusher engages the cable between the first and second ends and deflects the cable to unlatch the hood latch.

2. The system of claim 1 further comprising a fascia that is disposed proximate the bumper beam that actuates the cable pusher.

3. The system of claim 2 wherein the bumper beam includes first and second cable mounting features, wherein the cable is spaced apart from the bumper beam between the first and second cable mounting features.

4. The system of claim 2 further comprising a set of cable mounting rings that are fixedly disposed on the bumper beam, wherein the cable extends through the cable mounting rings.

5. The system of claim 2 wherein the first end is disposed between a bumper beam and a fascia that defines an exterior surface of the vehicle.

6. The system of claim 5 further comprising a set of cable mounting rings that are fixedly disposed on the fascia, wherein the cable extends through the cable mounting rings.

7. The system of claim 5 wherein deflection of the fascia causes the fascia to engage the cable between the first and second ends to actuate the linkage and unlatch the hood latch.

8. The system of claim 1 wherein the cable is in tension between the first end and the linkage.

9. The system of claim 1 wherein the linkage includes a first linkage end that is pivotally coupled to a pivot pin and a second linkage end disposed opposite the first linkage end that is connected to the hood latch.

10. The system of claim 9 wherein the cable is coupled to the linkage between the first and second linkage ends.

11. A system for unlatching a hood latch, comprising:

a bumper beam having an opening;

a cable pusher that is moveably disposed in the opening;

a linkage that is adapted to be pivotally disposed on a vehicle and that is connected to the hood latch;

a cable having a first end fixedly disposed on the bumper beam and a second end connected to the linkage; and a fascia that is disposed proximate the bumper beam and that defines an exterior surface of the vehicle, wherein the bumper beam is disposed between the fascia and the cable;

wherein deflection of the fascia in response to a vehicle impact event actuates the cable pusher through the opening to deflect the cable and the cable pusher deflects the cable to actuate the linkage and unlatch the hood latch.

12. The system of claim 11 wherein the cable pusher remains stationary when the fascia engages the cable pusher and does not exert a threshold force on the cable pusher.

13. The system of claim 11 wherein the cable pusher is spaced apart from the fascia prior to the vehicle impact event.

14. A system for unlatching a latch comprising:

a bumper beam having an opening;

a fascia disposed proximate the bumper beam defining a vehicle exterior surface;

a cable pusher received in the opening; and a cable disposed proximate the bumper beam and connected to the latch;

wherein the cable pusher moves through the opening to engage the cable to unlatch the latch when the fascia deflects to engage a first end of the cable pusher.

15. The system of claim 14 wherein the cable pusher has a second end disposed opposite the first end, wherein the second end has a concave indentation that receives the cable.

16. The system of claim 15 wherein the second end is spaced apart from the cable before the cable pusher is actuated with respect to the opening.

17. The system of claim 14 wherein the latch is a hood latch that selectively latches a hood of a vehicle.

* * * * *